US007219710B2

(12) United States Patent
Cheng

(10) Patent No.: US 7,219,710 B2
(45) Date of Patent: May 22, 2007

(54) LIFTING MECHANISM FOR WINDOW SHADES

(76) Inventor: Li-Ming Cheng, No.215, Jiouru 1st Rd., Sanmin District, Kaohsiung City (TW)

( * ) Notice: Subject to any disclaimer, the term of this patent is extended or adjusted under 35 U.S.C. 154(b) by 126 days.

(21) Appl. No.: 11/048,707

(22) Filed: Feb. 3, 2005

(65) Prior Publication Data

US 2006/0169421 A1 Aug. 3, 2006

(51) Int. Cl.
*E06B 9/30* (2006.01)

(52) U.S. Cl. ..... 160/170; 160/84.04

(58) Field of Classification Search ..... 160/170, 160/171, 178.1 R, 84.04, 84.05, 168.1 R; 185/37, 45; 242/375.3
See application file for complete search history.

(56) References Cited

U.S. PATENT DOCUMENTS 4,932,711 A * 6/1990 Goebel ..... 296/97.7
6,024,154 A 2/2000 Wang et al.
6,575,223 B1 * 6/2003 Chung et al. ..... 242/378.4
6,823,925 B2 * 11/2004 Militello et al. ..... 160/170
2002/0157796 A1 * 10/2002 Judkins ..... 160/84.04
2003/0111191 A1 * 6/2003 Ciuca et al. ..... 160/170

* cited by examiner

*Primary Examiner*—Blair M. Johnson
(74) *Attorney, Agent, or Firm*—Birch, Stewart, Kolasch & Birch, LLP

(57) ABSTRACT

Provided is a lifting mechanism for a shade including a plurality of continuous slats and two lift cords. The mechanism comprises a winding assembly, and a hoisting assembly fixedly attached to an inner surface of a lowest slat, the hoisting assembly comprising an elongated, hollow member of rectangular section including a bottom rectangular opening and two holes on its upper surface proximate both ends of the opening, and a channel fitted in the hollow member, the channel including a plurality of rollers across two raised walls thereof. The winding assembly is fixedly attached to an outer surface of the lowest slat. Either lift cord has one end terminated at a left (or right) portion of a topmost slat and the other end terminated at the winding assembly by passing left (or right) portions of the slats.

3 Claims, 5 Drawing Sheets

LIFTING MECHANISM FOR WINDOW SHADES

FIELD OF THE INVENTION

The present invention relates to shades and more particularly to an improved lifting mechanism mounted in a bottom slat of a window shade such that lifting or lowering of the shade will be smoother due to the support of the lifting mechanism.

BACKGROUND OF THE INVENTION

Conventionally, a shade is raised or lowered by pulling a lift cord. The lift cord is disposed externally of the shade. Thus, it is possible that the lift cord may tie children's necks for playing. This is very dangerous since the child may be hung accidentally. As such, the lift cord is typically concealed in a lifting mechanism in a lowest slat for safety reason.

FIG. 1 shows a window shade B incorporated a lifting mechanism A disclosed in U.S. Pat. No. 6,024,154. The lifting mechanism A is comprised of many components. As such, its components are mounted in a lower slat B1. This inevitably increases the size of the lower slat B1. Moreover, it increases the manufacturing cost, the weight of the lower slat B1, and winding force exerted on spring means of the lifting mechanism A, resulting in shortening the useful life of the shade. Thus, the need for improvement still exists.

SUMMARY OF THE INVENTION

It is therefore an object of the present invention to provide a lifting mechanism mounted in a shade including a plurality of slats attached together and two lift cords, comprising a lightweight winding assembly, and a hoisting assembly fixedly attached to an inner surface of a lowest slat, the hoisting assembly comprising an elongated, hollow member of rectangular section including a bottom rectangular opening and two holes on its upper surface proximate both ends of the opening, and a channel of U-section fitted in the hollow member, the channel including a lengthwise groove and a plurality of spaced rollers across two raised walls of the groove, wherein the winding assembly is fixedly attached to an outer surface of the lowest slat, one lift cord has one end terminated at a left portion of a topmost slat and the other end terminated at the winding assembly by passing left portions of the slats, and the other lift cord has one end terminated at a right portion of the topmost slat and the other end terminated at the winding assembly by passing right portions of the slats. By mounting the lifting mechanism in the shade, lifting or lowering of the shade will be smoother due to the support of the hoisting mechanism.

The above and other objects, features and advantages of the present invention will become apparent from the following detailed description taken with the accompanying drawings.

DETAILED DESCRIPTION OF THE PREFERRED EMBODIMENTS

Figure 1:
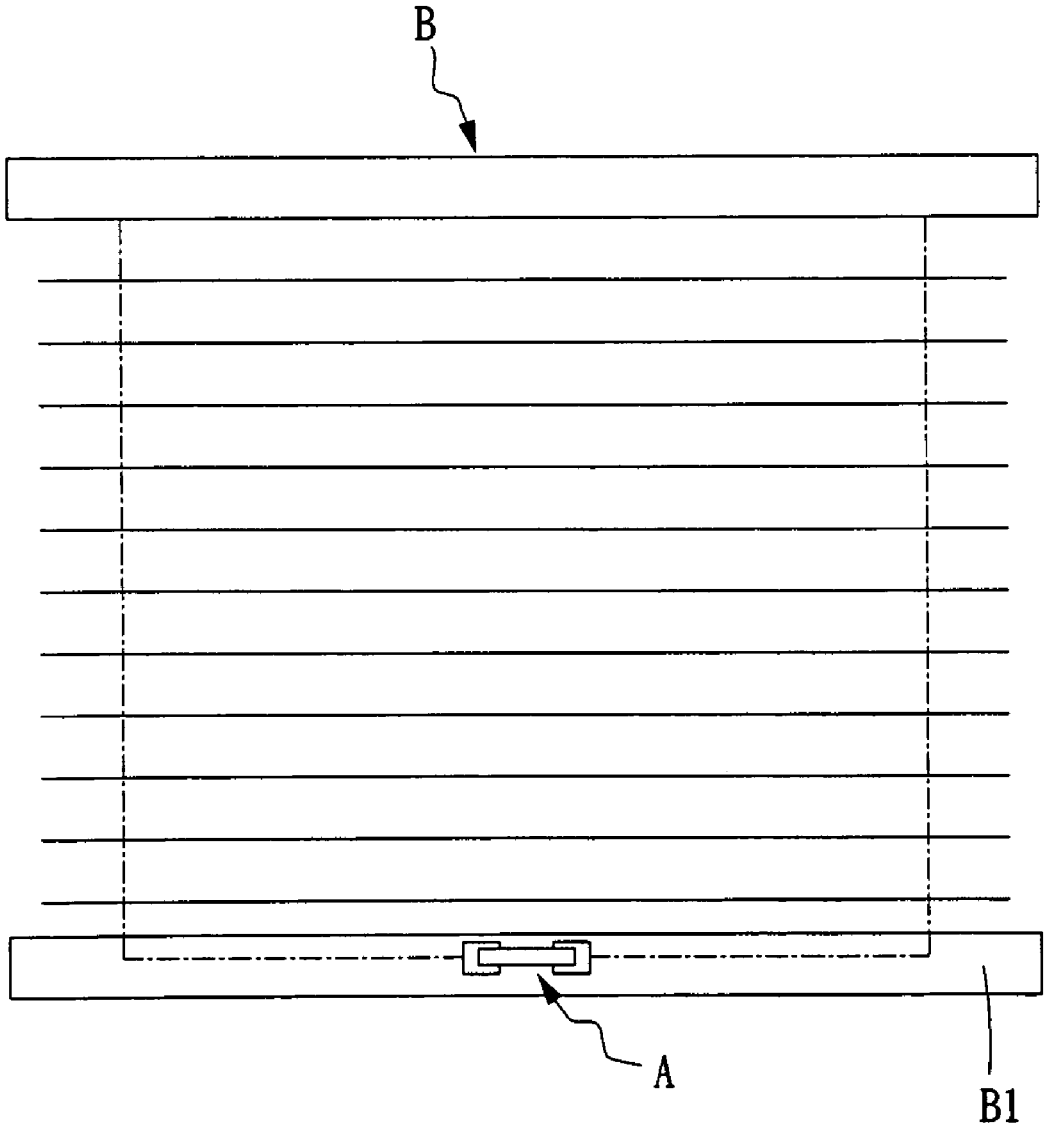
Fig. 1 PRIOR ART
FIG. 1 is a front view of a window shade incorporated a lifting mechanism disclosed in U.S. Pat. No. 6,024,154.
Figure 2:
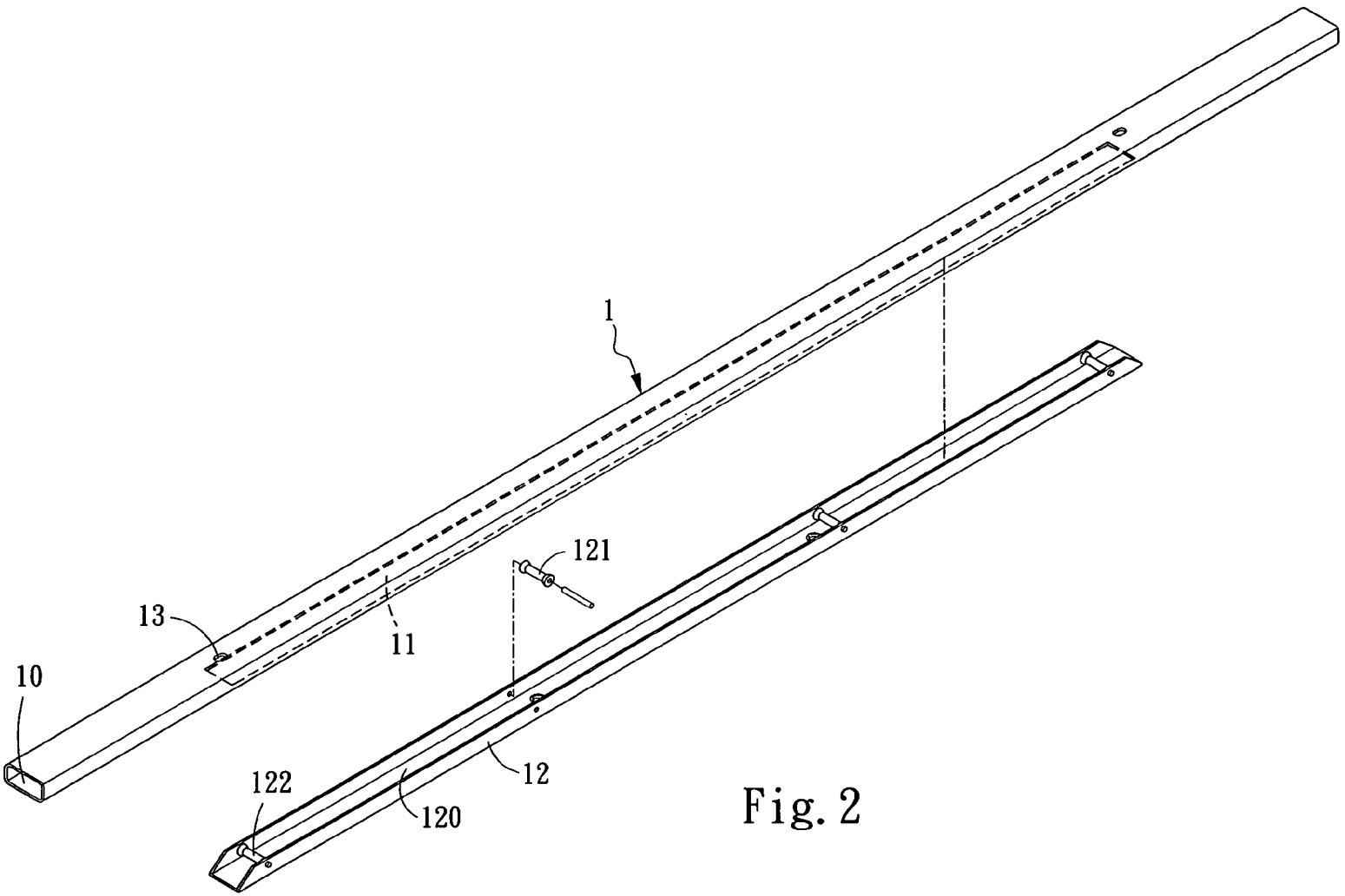
FIG. 2 is an exploded view of a hoisting assembly to be mounted in a lifting mechanism for shade according to the present invention.
Figure 3:
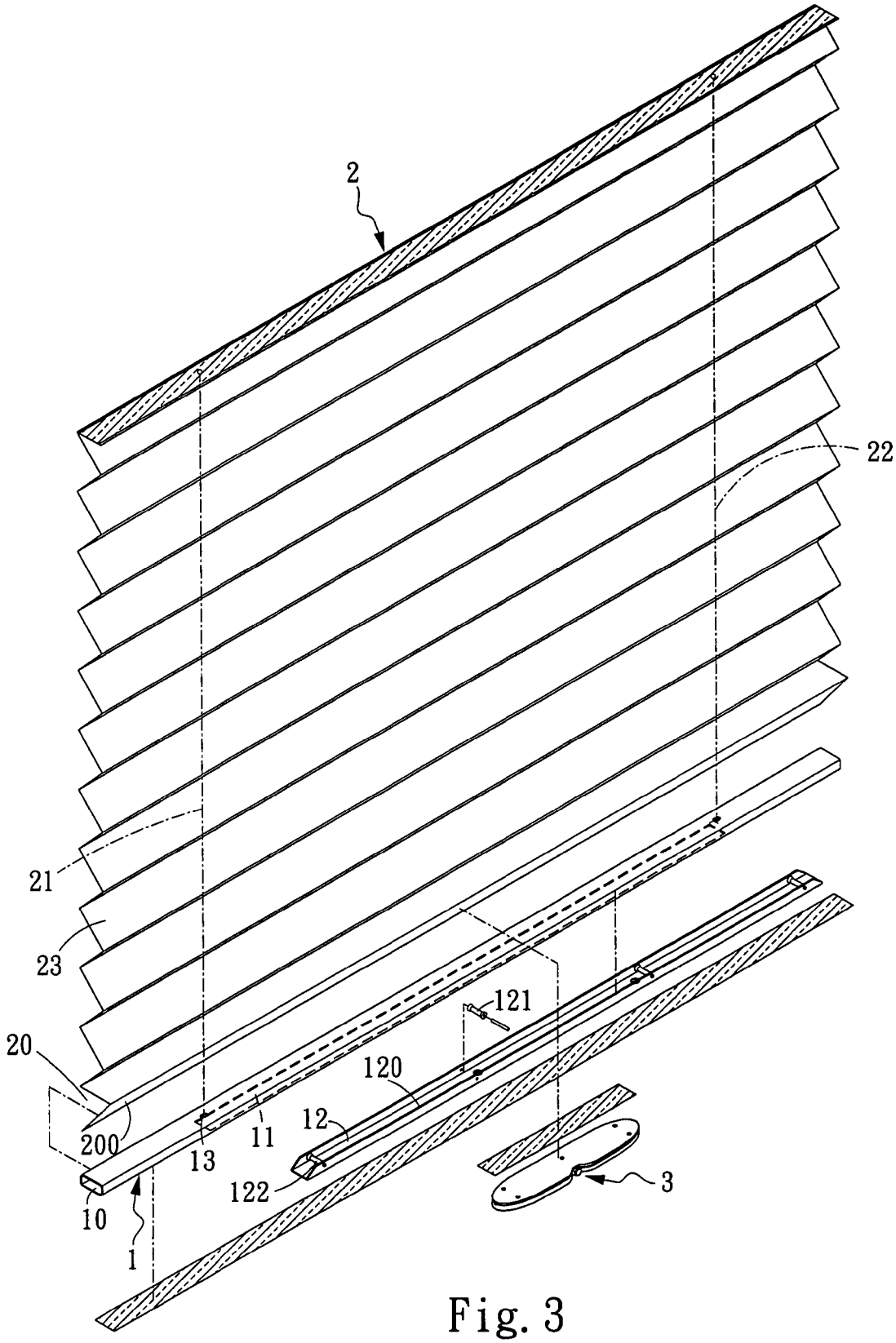
FIG. 3 is a perspective view of a shade to be assembled with the hoisting assembly and a winding assembly of the present invention in its lowest slat.
Figure 4:
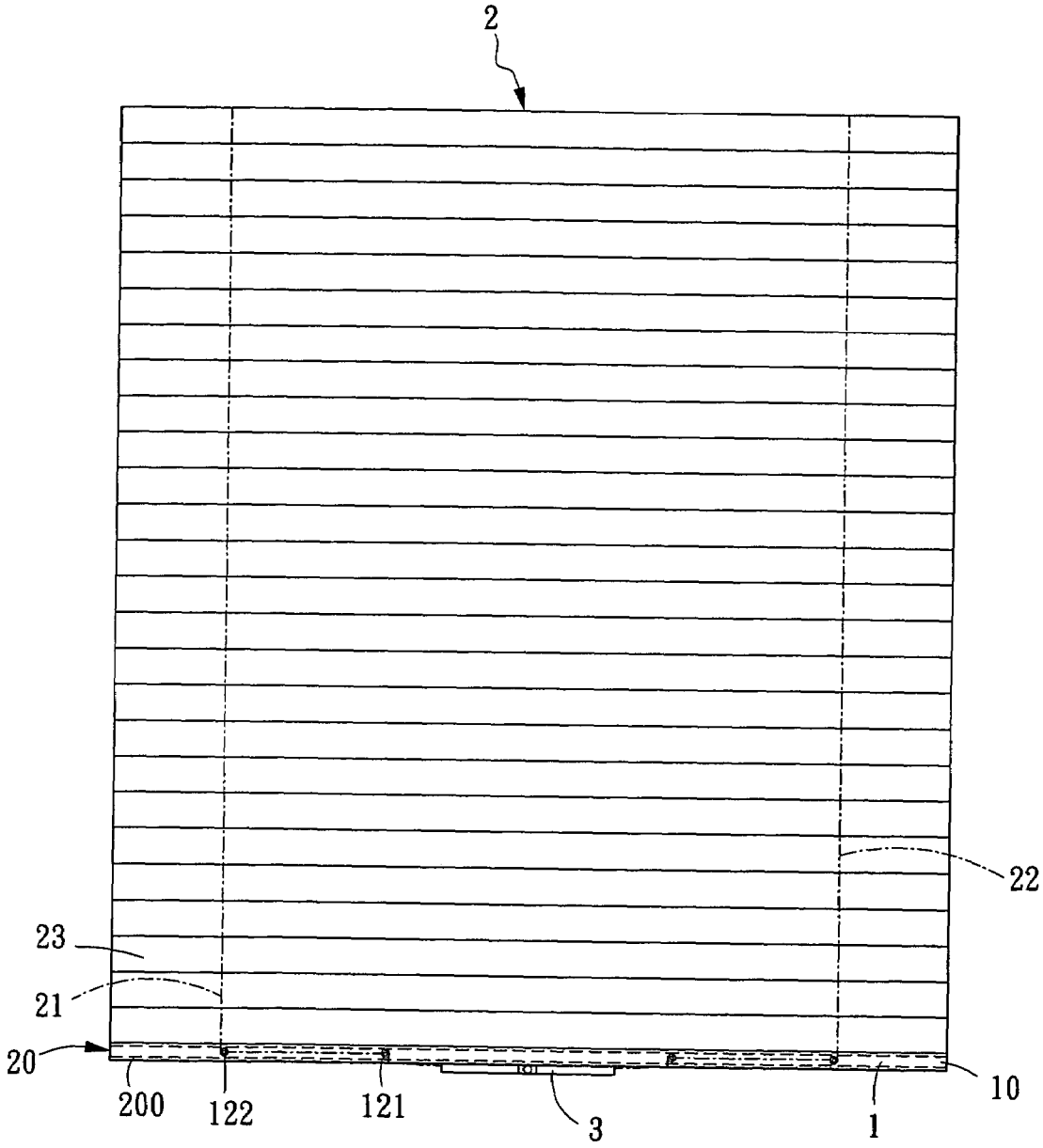
FIG. 4 is a front view of the assembled shade of FIG. 3.

Referring to FIGS. 2, 3, and 4, a shade 2 incorporated with a lifting mechanism (including elements 1 and 3) is constructed in accordance with a preferred embodiment of the present invention. The lifting mechanism comprises a small, lightweight winding assembly 3 and a hoisting assembly 1 attached to an inner surface of a bottom slat 200 in a bottom 20 of the shade 2 by adhesive. The hoisting assembly 1 comprises an elongated, hollow member 10 of rectangular section including a bottom rectangular opening 11 and two holes 13 on an upper surface of the hollow member 10 proximate both ends of the opening 11, and a channel 12 of U-section fitted in the hollow member 10, the channel 12 including a lengthwise groove 120 and a plurality of spaced rollers 121 and 122 across two raised walls of the groove 120. Each of two lift cords 21 and 22 has one end terminated at a left (or right) portion of a top slat 23 and the other end terminated at the winding assembly 3 by passing left (or right) portions of a plurality of slats 23, the left (or right) hole 13, and left rollers 121 and 122 (or right rollers 121 and 122). Note that the winding assembly 3 is attached to an outer surface of the bottom slat 200 in the bottom 20 of the shade 2 by adhesive.

Figure 5:
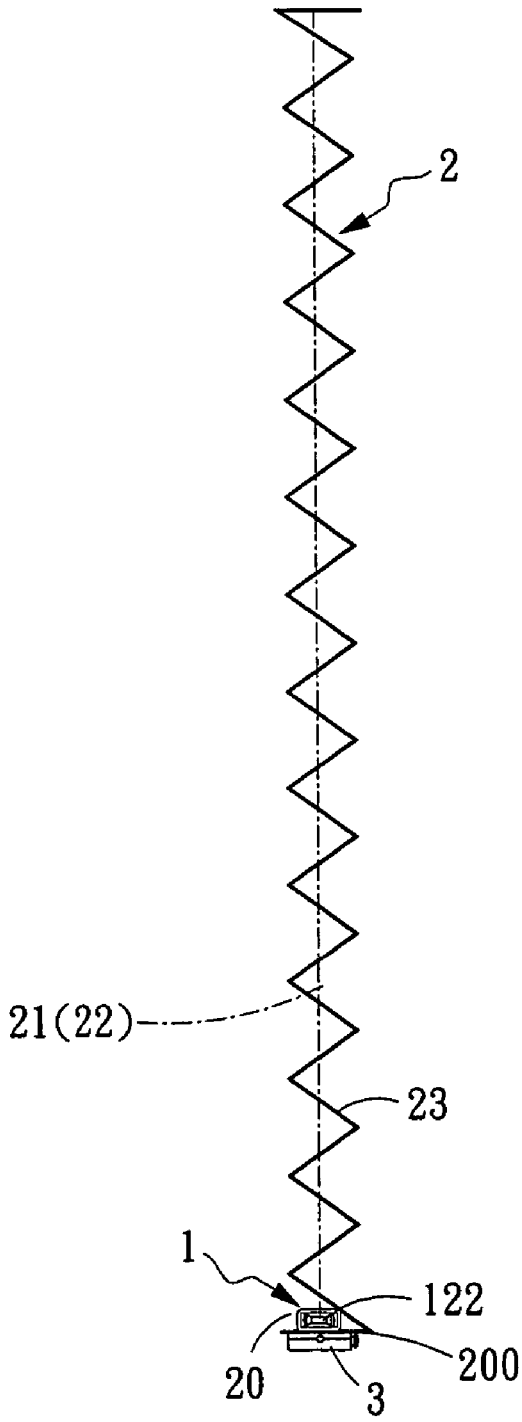
FIG. 5 is a side view of the shade of FIG. 4.

By configuring as above, the hoisting assembly 1 is able to provide an appropriate weight to the slats 23. As such, referring to FIG. 5, lifting or lowering of the shade 2 by pulling the lift cords 21 and 22 will be smoother without causing tilt of the slats 23.

While the invention herein disclosed has been described by means of specific embodiments, numerous modifications and variations could be made thereto by those skilled in the art without departing from the scope and spirit of the invention set forth in the claims.

What is claimed is:

1. A lifting mechanism mounted in a shade including a plurality of slats attached together and two lift cords, comprising:

a winding assembly, and a hoisting assembly fixedly attached to an inner surface of the lowest one of the slats, the hoisting assembly comprising an elongated, hollow member of rectangular section including a bottom rectangular opening, and a channel of U-section fitted in the hollow member, wherein the winding assembly is fixedly attached to an outer surface of the lowest one of the slats, one lift cord has one end terminated at a left portion of the topmost slat and the other end terminated at the winding assembly by passing left portions of the slats, and the other lift cord has one end terminated at a right portion of the topmost slat and the other end terminated at the winding assembly by passing right portions of the slats.

2. The lifting mechanism of claim 1, wherein the channel comprises a lengthwise groove and a plurality of spaced rollers installed on two sides of the groove correspondingly.

3. The lifting mechanism of claim 1, wherein the hollow member further comprises two holes on its upper surface proximate both ends of the opening.

* * * * *